United States Patent [19]

Porter

[11] 4,181,069

[45] Jan. 1, 1980

[54] METHOD FOR PRODUCING DOUBLE STREAMS OF SIDE-WELDED BAGS IN HEAT-WELDED PAD FORM

[75] Inventor: James F. Porter, East Norwalk, Conn.

[73] Assignee: Chase Bag Company, Greenwich, Conn.

[21] Appl. No.: 901,187

[22] Filed: Apr. 28, 1978

[51] Int. Cl.[2] ..... B31B 1/64; B31B 23/14

[52] U.S. Cl. ..... 93/35 R; 93/33 H

[58] Field of Search ..... 93/33 H, 93 HT, 35 R, 93/DIG. 1; 156/515, 583

[56] References Cited

U.S. PATENT DOCUMENTS

| | | | |
|---|---|---|---|
| 3,433,136 | 3/1969 | Hartbauer et al. | 225/96 X |
| 3,791,267 | 2/1974 | Brooks | 93/DIG. 1 X |
| 3,893,382 | 7/1975 | Bosse et al. | 93/93 HT |
| 4,083,747 | 4/1978 | Rochla | 93/33 H |

*Primary Examiner*—Gil Weidenfeld

*Attorney, Agent, or Firm*—Cooper, Dunham, Clark, Griffin & Moran

[57] ABSTRACT

The invention relates to the production of bags from a web of plastic film, such as polyethylene and the like, which is unreeled from a parent roll and caused to pass over a forming device to provide what is known as a "J" fold. More particularly, it provides a method and apparatus for producing double streams of side-welded bags in heat-welded pad form, wherein two "J" folds are provided on opposite sides of the film as it is unreeled from the parent roll to form two oppositely-disposed bags, severable from each other, and suitably mountable in stacked form as welded pads, or for mounting on wickets, pins, or the like. It also provides a novel stack of bags in pad form adapted to be mounted on clip boards or the equivalent, or on wickets, pins, or the like, and each individually severable from the pad to receive and package various types of merchandise.

6 Claims, 8 Drawing Figures

Fig. 1.
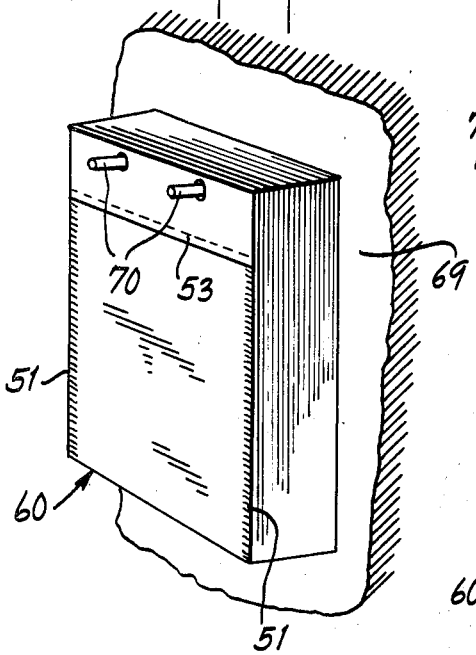
Fig. 1A.
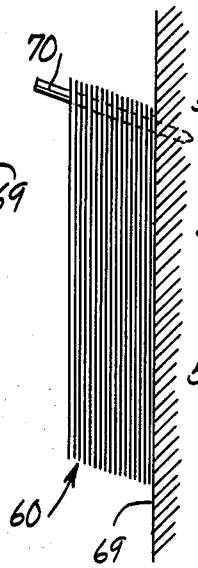
Fig. 2.
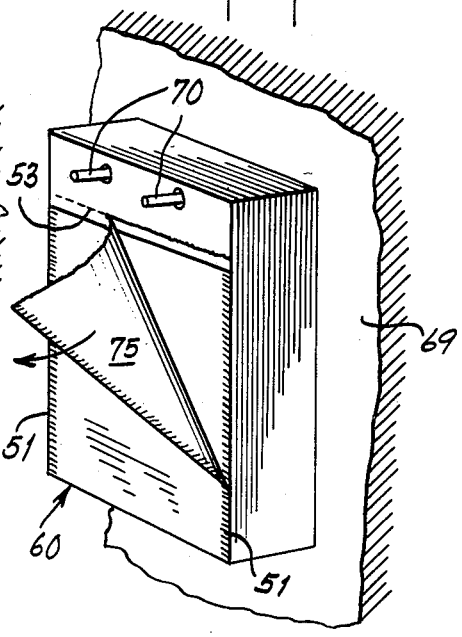
Fig. 3.
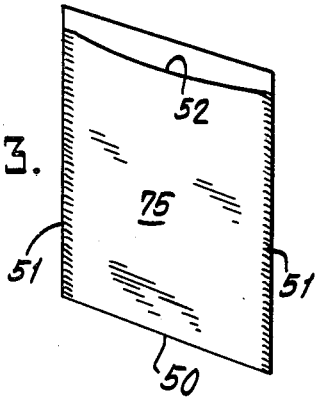
Fig. 4.
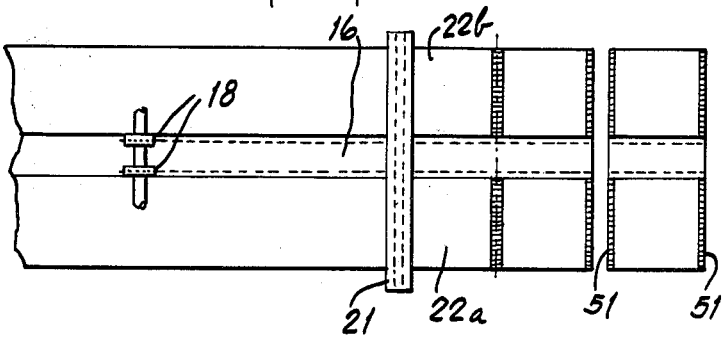
Fig. 5.
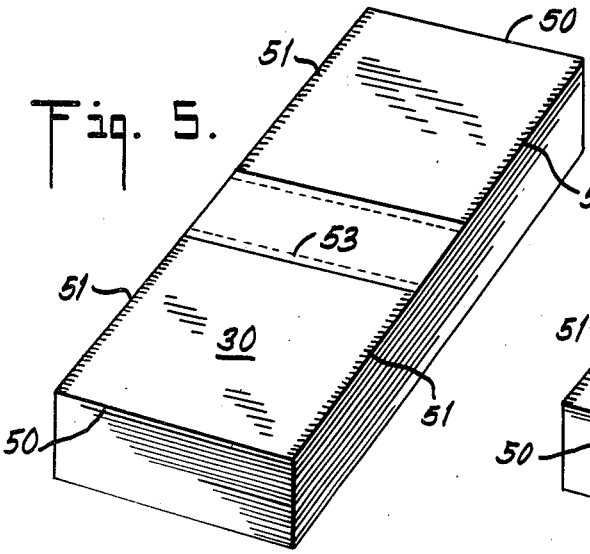
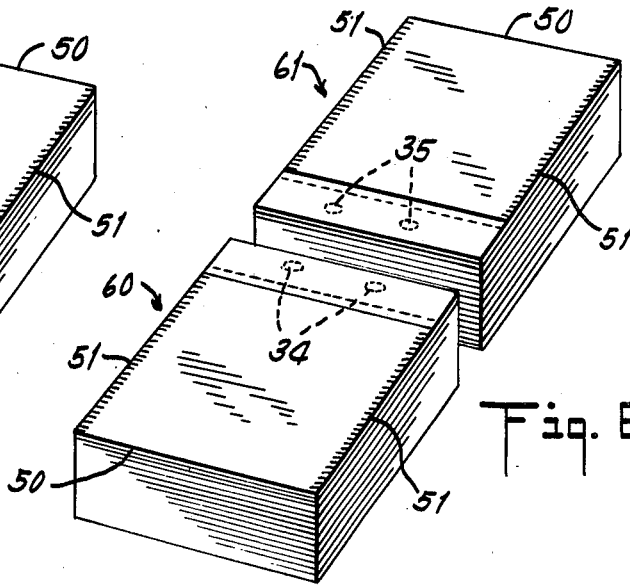
Fig. 6.

METHOD FOR PRODUCING DOUBLE STREAMS OF SIDE-WELDED BAGS IN HEAT-WELDED PAD FORM

The present invention relates to the production of bags from a web of plastic film, such as polyethylene and the like, which is unreeled from a parent roll and caused to pass over a forming device to provide what is known as a "J" fold, wherein the "J" folded film is side-welded transversely at spaced distances along the longitudinal axis of the film to provide individual bags-,—the "J" fold forming the bottom of the bag and an open top to receive and package various types of merchandise. The type of bag to which the present invention relates is usually provided with a pair of holes in the back wall of the upper open end of the bag to receive a pair of pins or wickets to support such bags on a wall or other mounting having such wickets or pins secured thereto.

More particularly, the present invention provides a method and apparatus for producing double streams of side-welded bags in heat-welded pad form, wherein two "J" folds are provided on opposite sides of the film as it is unreeled from the parent roll to form two oppositely-disposed bags, severable from each other, and suitably mountable in stacked form as welded pads, or for mounting on wickets, pins, or the like. The present invention also provides a novel stack of bags in pad form adapted to be mounted on clip boards or the equivalent, or on wickets, pins, or the like, and each individually severable from the stack to receive and package various types of merchandise.

PRIOR ART

The following U.S. patents generally relate to the field of the present invention, but most of them are only peripherally pertinent: French U.S. Pat. No. 2,279,279; Haugh U.S. Pat. No. 2,423,187; Waters U.S. Pat. No. 2,444,685; Zerlin, et al. U.S. Pat. No. 2,799,211; Klasing, et al. U.S. Pat. No. 2,805,700; Osborn, Jr. U.S. Pat. No. 3,156,010; Simecek, et al. U.S. Pat. No. 3,372,625; Gwinn, et al. U.S. Pat. No. 3,406,611; Hartbauer, et al. U.S. Pat. No. 3,433,136 and Hook, U.S. Pat. No. 3,656,415.

Of the foregoing prior art patents, it is believed only the patent to Hartbauer, et al. requires individual discussion. This patent shows a method and apparatus for producing and stacking bags formed from Heat-sealable material wherein the individual layers of film are first provided with a pair of spaced transverse lines of weakness, with one of such transverse lines of weakness being more easily ruptured than the other. Thereafter the individual webs are turned at a right angle to overlie each other, with the lines of weakness of adjacent webs in vertical alignment.

SUMMARY OF INVENTION

The present invention provides a method and apparatus for fabricating stacks of plastic bags in welded pad form adapted to be mounted on a clip board or the like, or on a pair of wickets, pins, or the like, the bags being side-welded and open at their tops and individually severable from the stack along a line of perforation above the open end of each bag and below a spring-actuated clip, wickets, pins, or the like. The bags are formed from a single roll of plastic material which is continuously fed through a pair of "J" formers which turn the outer edges of the film inwardly toward each other to provide oppositely-disposed "J" folds with the inner edges of the "J" folds leaving a single ply thickness longitudinally along the film. The single ply thickness outwardly of the top edge of each "J" fold is provided with a line of perforation; the "J" folded film with its line of perforation is transversely heat-sealed at spaced distances to provide side-welds for the bag being formed; the bags are severed transversely from each other midway of the side-welds and successively stacked; the stacked bags are vertically heat-welded into pads. They also may be punched to provide two holes in the single ply portion of each bag inwardly of each open end; the bags are severed from each other at their midpoint to provide two pads or bags; and the bags are then mountable in pads on supporting clip boards or the like, or on wickets, pins, or the like, which are inserted through holes formed in the single plies of each pad of bags; the bags being individually separable from the mounted pads along the line of perforation inwardly of the upper open end for the packaging of various types of merchandise.

DETAILED DESCRIPTION OF INVENTION

For a better understanding of the invention reference will now be made to the accompanying drawings wherein:

FIG. 1 is a perspective view of a pad of bags prepared in accordance with the present invention, mounted on two wickets supported from a wall or other mounting surface.

FIG. 1A is a side elevational view of FIG. 1.

FIG. 2 is a view similar to FIG. 1 showing one of the bags partially torn away from the stack to receive commodities to be packaged therein.

FIG. 3 is a perspective view of an individual bag after being torn from the stack of bags shown in FIGS. 1 and 2.

FIG. 4 is a fragmentary plan view of part of the apparatus for forming the stacks of bags in accordance with the present invention.

FIG. 5 is a perspective view of two stacks of bags formed on the apparatus of the present invention prior to being heat-welded and severed to provide two heat-welded pads of bags.

FIG. 6 is a view similar to FIG. 5 showing the two stacks of bags after they have been heat-welded and severed for mounting on a clip board or the like; the figure also showing in dotted lines how the pads of bags would look if also hole punched for mounting on wickets, pins and the like.

Figure 7:
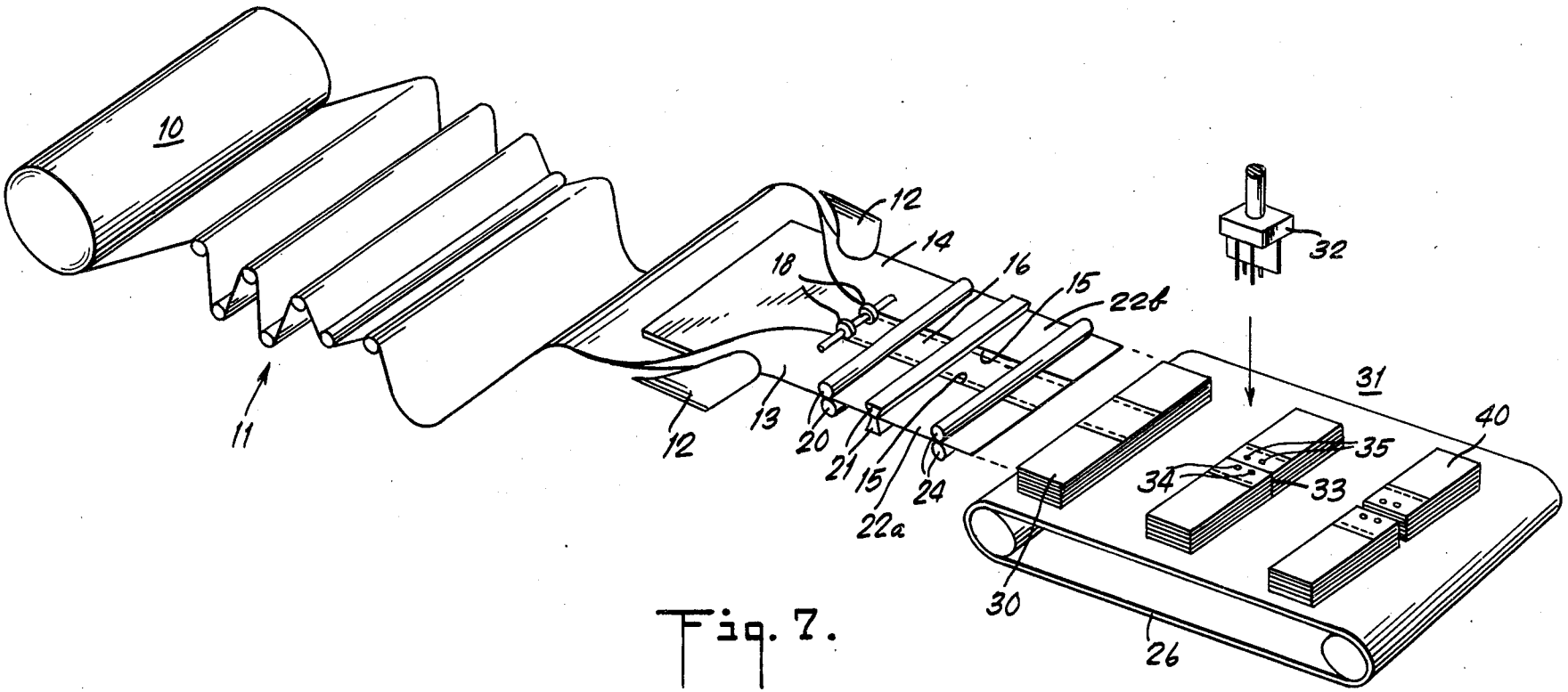
FIG. 7 is a schematic perspective view of the essential elements of the apparatus of the present invention for producing the stacks of bags shown in FIGS. 1, 2 and 6.

Referring now to the drawings more in detail, FIG. 7 shows a perspective schematic view of the essentials of the apparatus forming part of the invention for producing the stacks of bags for mounting on clip boards or the equivalent, or on wickets, pins or the like. In its essentials a roll of plastic film such as polyethylene and the like 10 (sometimes known as the parent roll) of suitable width so as to provide two stacks of bags, is led over a series of accumulator rolls 11 to a forming device 12 where both side edges of the film are turned inwardly to provide two oppositely disposed "J" folds 13, 14, each having an inner fold edge 15 which are spaced apart from each other and which reveal the underlying single ply 16. Slightly exteriorly of each edge 15, a pair of rotary perforating knives 18 provides a series of perforations in the inner ply 16 as it is moved through the machine. Feed of the "J" folds through the machine is accomplished by two draw rolls 20 which are suitably driven. A pair of cooperating cutting and sealing knife bars 21 serve to side-weld the "J" folds transversely and at spaced distances to the underlying ply and also transversely to sever the two bags **22*a* and 22*b* thereby formed from the strip and to deliver through feed rolls 24 such joined bags to an endless conveyor 26 where they are stacked in a predetermined number as shown at 30. After being stacked in a predetermined number the stacks of bags are moved to a heat-welding and cutting station 31 where two pairs of heat-welding elements and a cutter 32 cuts the double set of bags at their midpoint 33 and simultaneously heat welds the same into two heat-welded pads of bags. As an alternative to just heat-welding and severing, station 31 can also punch two holes in the upper single ply of each bag as shown at 34 and 35. From the cutting and welding station 31 the two stacks of bags are moved to the delivery station 40** where they are ready for removal.

Referring now to FIG. 5 of the drawings which shows an enlarged view of the stack of semi-finished bags 30 prior to heat-welding, severing and hole punching (if desired), it will be noted that the "J" fold of the film forms the bottom 50 of each bag, and that each bag has two side-welds 51 and an open top 52 which is spaced inwardly of the line of perforation 53.

FIG. 6, in turn, is a similar enlarged perspective view of the finished bags after they have been severed into two welded pads 60, 61 for mounting on a clip board or the like. In the same figure there is also shown welded pads with through holes 34, 35 (dotted line) in the upper end of the bag in the single ply area 16. The holes 34, 35 may be done by a punching operation or by heated elements which sear the film to form the holes. A combination tool for severing, welding and punching is shown at 32 in FIG. 7.

As best shown in FIGS. 1 and 2, the finished pads of bags (if hole punched) may be mounted on a wall or other supporting panel 69 by wickets or pins 70 which engage in the holes 34, 35. When it is desired to remove a bag from the stack as shown in FIG. 1, it is merely torn along the line of perforation 53 to produce the bag 75 shown in FIG. 3 which has a closed bottom 50, two side-welds 51, an open mouth 52, and a small extension of the back 76. If the pads of bags are not hole punched, the pads may be similarly mounted by means of a spring-actuated clamp such as used on a clip board. The spring clamp will engage the pad of bags above the line of perforation 53.

From the foregoing description it will be understood that the present invention has provided a method and apparatus for producing from a single roll of plastic film, two sets of bags in welded pad form for mounting on a clip board, or on wickets, pins, or the like, with virtually no waste of material, which are side-welded, and which only require one line of perforation to separate each individual bag from the pad. The economics effected by the present invention in forming pads of bags for use on clip boards and the like, or on wickets, pins, or the like, are of great significance in the bag making and packaging industry, wherein the elimination of complicated machinery or parts of apparatus and the minimizing of waste material is of major importance.

What I claim is:

1. The method of producing bags from a single web of plastic film which is unreeled from a parent roll comprising the steps of:

(a) continuously passing a web of plastic film through a pair of "J" formers which turn the outer edges of the film inwardly toward each other to provide oppositely-disposed "J" folds with the inner edges of the "J" folds spaced from each other and leaving a single ply thickness longitudinally along the film;

(b) continuously perforating the single ply longitudinally and outwardly of the top edge of each "J" fold to provide a line of perforation adjacent each such outer edge;

(c) transversely heat sealing said "J" folded film at spaced distances to provide side-welds for the bags being formed;

(d) severing the semi-finished bags transversely midway of the side-welds;

(e) successively stacking the oppositely-disposed semi-finished bags in a predetermined number;

(f) heat-welding the single ply portion of the open end of each bag to provide two pads of semi-finished bags; and (g) severing the oppositely-disposed pads of semi-finished bags from each other to provide two heat-welded pads of finished bags.

2. The method according to claim 1 wherein steps (f) and (g) are performed simultaneously.

3. The method of producing bags from a single web of plastic film which is unreeled from a parent roll comprising the steps of:

(a) continuously passing a web of plastic film through a pair of "J" formers which turn the outer edges of the film inwardly toward each other to provide oppositely-disposed "J" folds with the inner edges of the "J" folds spaced from each other and leaving a single ply thickness longitudinally along the film;

(b) continuously perforating the single ply longitudinally and outwardly of the top edge of each "J" fold to provide a line of perforation adjacent each such outer edge;

(c) transversely heat sealing said "J" folded film at spaced distances to provide side-welds for the bags being formed;

(d) severing the semi-finished bags transversely midway of the side-welds;

(e) successively stacking the oppositely-disposed semi-finished bags in a predetermined number;

(f) heat-welding the single ply portion of the open end of each bag to provide two pads of semi-finished bags;

(g) providing at least two holes in the single ply heat-welded portion outwardly of the open end of each bag; and (h) severing the oppositely-disposed pads of semi-finished bags from each other to provide two pads of finished bags.

4. The method according to claim 3 wherein steps (f), (g) and (h) are performed simultaneously.

5. The method according to claim 3 wherein step (g) is performed by vertically movable hole punchers.

6. The method according to claim 3 wherein step (g) is performed by vertically movable searing elements.

* * * * *